US010793242B2

(12) United States Patent
Wilby et al.

(10) Patent No.: US 10,793,242 B2
(45) Date of Patent: Oct. 6, 2020

(54) UNDERWATER VEHICLE HAVING DIRECTIONAL EFFECTOR

(71) Applicant: Raytheon Company, Waltham, MA (US)

(72) Inventors: Andrew D. Wilby, Warwick, RI (US); Joseph M. Misulia, Attleboro, MA (US)

(73) Assignee: Raytheon Company, Waltham, MA (US)

( * ) Notice: Subject to any disclaimer, the term of this patent is extended or adjusted under 35 U.S.C. 154(b) by 84 days.

(21) Appl. No.: 16/204,343

(22) Filed: Nov. 29, 2018

(65) Prior Publication Data

US 2020/0172216 A1 Jun. 4, 2020

(51) Int. Cl.

| | |
|---|---|
| ***B63G 8/28*** | (2006.01) |
| ***B63G 8/22*** | (2006.01) |
| ***B63B 21/44*** | (2006.01) |
| ***B63G 8/38*** | (2006.01) |
| *F42B 15/20* | (2006.01) |

(52) U.S. Cl.

CPC ..... *B63G 8/22* (2013.01); *B63B 21/44* (2013.01); *B63G 8/38* (2013.01); *F42B 15/20* (2013.01)

(58) Field of Classification Search

CPC ..... B63G 8/00; B63G 8/001; B63G 8/002; B63G 8/005; B63G 8/14; B63G 8/22; B63G 8/24; B63G 8/28; B63G 8/38; B63G 13/00; B63B 21/24; B63B 21/44; B63B 21/50; B63B 21/508; F42B 15/20; F42B 12/58; F42B 21/00

USPC ..... 114/312, 313, 316, 317, 320, 321, 330, 114/337, 342, 293, 294; 102/390–392

See application file for complete search history.

(56) References Cited

U.S. PATENT DOCUMENTS

| | | | | |
|---|---|---|---|---|
| 4,805,549 | A * | 2/1989 | Svenning | B63G 8/001 114/325 |
| 5,076,170 | A | 12/1991 | Seiple | |
| 5,653,404 | A * | 8/1997 | Ploshkin | B63G 8/00 244/12.2 |
| 6,276,294 | B1 * | 8/2001 | Geriene | B63C 11/42 114/245 |
| 7,337,741 | B1 | 3/2008 | Ansay et al. | |
| 8,056,461 | B2 | 11/2011 | Bossert et al. | |
| 9,200,879 | B2 | 12/2015 | Kumano | |
| 9,381,980 | B1 | 7/2016 | Rush, III | |
| 9,422,034 | B2 | 8/2016 | Bauer et al. | |
| 9,745,034 | B2 | 8/2017 | Childress et al. | |
| 9,873,494 | B2 | 1/2018 | Jewell | |
| 10,479,465 | B2 * | 11/2019 | Moreno | B63G 8/08 |
| 10,518,854 | B2 * | 12/2019 | Harman | B63C 11/52 |

(Continued)

*Primary Examiner* — Daniel V Venne

(74) *Attorney, Agent, or Firm* — Renner, Otto, Boisselle & Sklar, LLP

(57) ABSTRACT

An underwater vehicle includes a plurality of releasable panel members that are initially in a storage state in which the releasable panel members form a closed housing and the underwater vehicle is neutrally buoyant, an actuatable effector that is retained in the closed housing. The effector has an anchor and a positively buoyant upper unit opposite the anchor. When the plurality of releasable panel members are released to open the closed housing, the effector is separable from the releasable panel members and maintained in a vertically downward direction by the anchor and the positively buoyant upper unit.

20 Claims, 5 Drawing Sheets

(56) References Cited

U.S. PATENT DOCUMENTS

| | | | |
|---|---|---|---|
| 2017/0081005 | A1 | 3/2017 | Lichter et al. |
| 2018/0127073 | A1 | 5/2018 | Elder |

* cited by examiner

UNDERWATER VEHICLE HAVING DIRECTIONAL EFFECTOR

FIELD OF THE INVENTION

The invention relates to an underwater vehicle having a deployable, directional effector.

DESCRIPTION OF THE RELATED ART

Conventional methods of reaching a target located on a seabed include using an underwater vehicle that is expended upon reaching the target. For example, the underwater vehicle may be a powered one-shot vehicle carrying a munition, such as a warhead. Conventional underwater vehicles may be disadvantageous in that expending a one-shot powered munition may not be economical due to high cost. The powered munition may be replaced with a less costly, stationary munition capable of producing the energy needed to reach the target; however, maintaining directional accuracy of the energy stream may be challenging, particularly if the target is located on an uneven area of the seabed.

SUMMARY OF THE INVENTION

The underwater vehicle described herein enables an effector to accurately reach a target on an uneven seabed by providing a buoyantly positive housing that maintains a vertical orientation of the effector opposite an anchor that pulls the effector towards the target on the seabed. The underwater vehicle is configured to move from a storage state in which the vehicle is neutrally buoyant to a released state in which the underwater vehicle is pulled to the seabed by the anchor. The change in buoyancy state of the underwater vehicle is provided by using releasable foam panel members that are engaged with each other to form a closed housing that encloses the effector when the underwater vehicle is in the storage state. Due to the buoyantly positive housing, which may also be formed of foam, and the foam panel members, the buoyantly negative force of the anchor is countered to enable the underwater vehicle to be neutrally buoyant, such as when the underwater vehicle is being carried by an autonomous or controlled vehicle toward the target on the seabed.

The releasable foam panel members are also separable from the underwater vehicle when the effector is to be deployed to the seabed. The panel members are held together by a retaining band that is broken to release the panel members from engagement with each other. Magnetic arms that are attached to the panel members are then able to pivot about a magnet contact point to trigger a switch in an electronics housing of the underwater vehicle that is used to control the effector. After the switch has been triggered by pivoting of the magnetic arms, the magnetic arms are further pivotable about the magnet contact points to a predetermined point at which the magnetic arms are then released from the magnet contact points to move away from the electronics housing and the underwater vehicle. The buoyancy of the foam panel members enables the panel members and the magnetic arms to float upwardly through the water such that the foam panel members may advantageously be retrieved and reused even if the remaining components of the underwater vehicle are expended.

The underwater vehicle having directionality may advantageously be configured for various underwater applications including both countermeasure type applications and underwater imaging applications. The effector may be a shaped charge or a low-cost munition that is expended upon reaching a target on the seabed. In other embodiments, the effector may be an imaging device that is not expended upon reaching the target on the seabed. In any application, the underwater vehicle is advantageously maintained in a vertical direction by the buoyantly positive housing opposite the anchor and providing elastic bands between the effector and the anchor that enable the anchor to have a non-horizontal orientation while the housing and the effector will be maintained in a vertical orientation. Accordingly, an advantage of the underwater vehicle is that the orientation of the effector is known.

According to an aspect of the invention, an underwater vehicle includes a deployable, directional effector.

According to an aspect of the invention, an underwater vehicle includes a positively buoyant member and a negatively buoyant member to maintain a vertical orientation of an effector.

According to an aspect of the invention, an underwater vehicle includes a separable and reusable housing that is separable from an effector housed within the housing.

According to an aspect of the invention, an underwater vehicle includes a plurality of releasable panel members that are initially in a storage state in which the releasable panel members form a closed housing and the underwater vehicle is neutrally buoyant, and an actuatable effector that is retained in the closed housing, the effector having an anchor and a positively buoyant upper unit opposite the anchor. When the plurality of releasable panel members are released to open the closed housing, the effector is separable from the releasable panel members and maintained in a vertically downward direction by the anchor and the positively buoyant upper unit.

According to an embodiment of any paragraph(s) of this summary, the underwater vehicle may include an electronics housing that is attached to the effector for actuating the effector.

According to an embodiment of any paragraph(s) of this summary, the electronics housing may include a plurality of magnetic sensors.

According to an embodiment of any paragraph(s) of this summary, each of the plurality of releasable panel members may include a magnet that is engageable with a corresponding one of the plurality of magnetic sensors.

According to an embodiment of any paragraph(s) of this summary, the magnet may be an elongated strip having a releasable end that is pivotable about a magnet contact point of the electronics housing and a fixed end portion that is bonded to the releasable panel.

According to an embodiment of any paragraph(s) of this summary, the underwater vehicle may include a retaining band that surrounds the plurality of releasable panel members when in the storage state.

According to an embodiment of any paragraph(s) of this summary, the retaining band may include a burn fuse material for releasing the plurality of releasable panel members to open the closed housing.

According to an embodiment of any paragraph(s) of this summary, the anchor may include a ballast material.

According to an embodiment of any paragraph(s) of this summary, the anchor may include a plurality of elastic bands connected between the anchor and the effector.

According to an embodiment of any paragraph(s) of this summary, the anchor may include a spike tripod.

According to an embodiment of any paragraph(s) of this summary, the effector may be a shaped charge munition.

According to an embodiment of any paragraph(s) of this summary, the effector may include an imaging device or camera.

According to an embodiment of any paragraph(s) of this summary, the plurality of releasable panel members may be formed of a buoyant foam material.

According to an embodiment of any paragraph(s) of this summary, the positively buoyant upper unit may be a foam housing that encompasses the effector and is arranged between the effector and the plurality of releasable panel members.

According to an embodiment of any paragraph(s) of this summary, the foam housing may be tapered along the effector toward the anchor.

According to another aspect of the invention, a method of deploying an underwater vehicle includes arranging a plurality of releasable panel members initially in a storage state in which the releasable panel members form a closed housing and the underwater vehicle is neutrally buoyant, inserting an actuatable effector in the closed housing, the effector having an anchor, a positively buoyant upper unit opposite the anchor, and an electronics housing, releasing the plurality of releasable panel members to release the effector from the closed housing, and maintaining the effector in a vertical orientation using the anchor and the positively buoyant upper unit.

According to an embodiment of any paragraph(s) of this summary, the method may further include actuating the effector using magnets of the plurality of releasable panel members that engage magnet contact points of the electronics housing when the plurality of releasable panel members are released.

According to an embodiment of any paragraph(s) of this summary, releasing the plurality of releasable panel members may include burning a burn fuse material of a retaining band that surrounds the plurality of releasable panel members when in the storage state.

According to an embodiment of any paragraph(s) of this summary, maintaining the effector in a vertical orientation may include using a plurality of elastic bands between the anchor and the effector that enable the anchor to pivot relative to the effector.

According to an embodiment of any paragraph(s) of this summary, the method may include separating the plurality of releasable panel members from the effector and reusing the plurality of releasable panel members to form another underwater vehicle.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have particular application in underwater vehicles that are suitable for use in various applications. Exemplary applications in which an underwater vehicle may be suitable for use include active countermeasure applications and underwater imaging applications. An underwater vehicle that includes a directional and actuatable effector for reaching a specific target on an uneven seabed may be suitable for use in other underwater applications.

Figure 1:
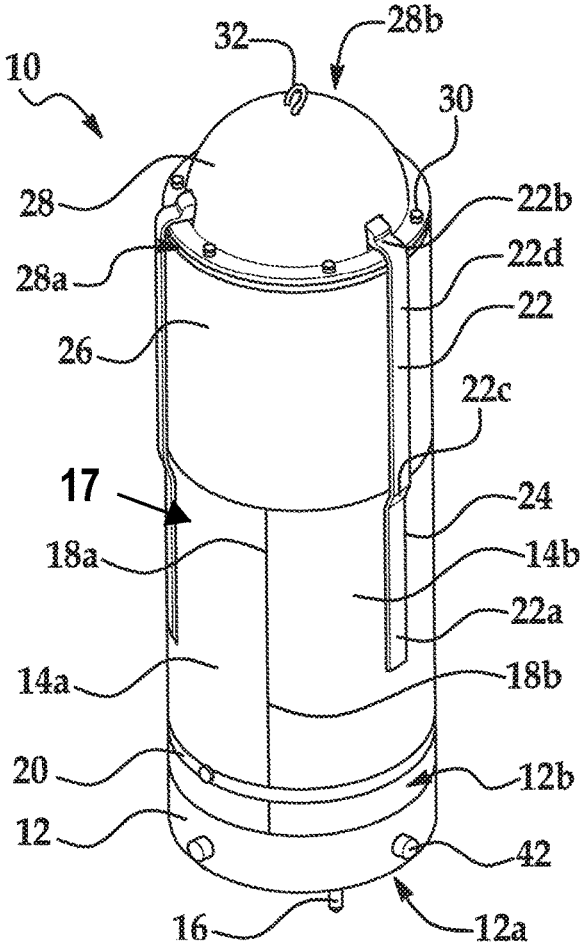
FIG. 1 is a schematic drawing showing a perspective view of an underwater vehicle when in a storage state according to an embodiment of the present invention.
Figure 2:
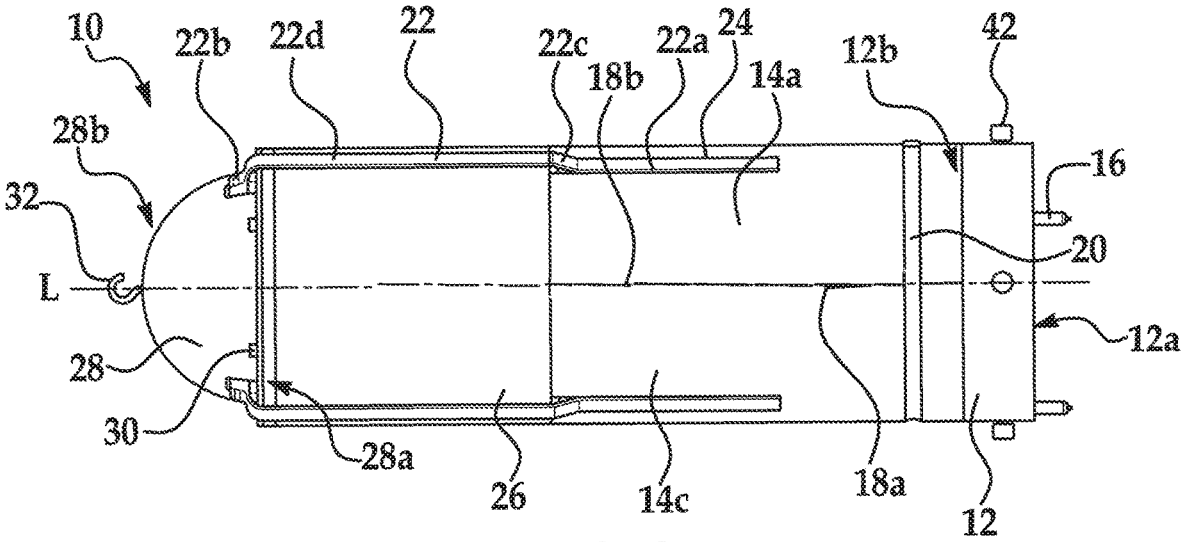
FIG. 2 is a schematic drawing showing a side perspective view of the underwater vehicle shown in FIG. 1.

Referring first to FIGS. 1 and 2, an underwater vehicle 10 is shown in a storage state in which the underwater vehicle 10 may be unpowered. The underwater vehicle 10 includes an anchor 12 and a plurality of releasable panel members 14*a*, 14*b*, 14*c* that are arranged along a longitudinal axis L of the underwater vehicle 10. The anchor 12 may have any suitable shape and be formed of any ballast material. For example, the anchor 12 may be cylindrical or ring-shaped and formed of a heavy metal material such as lead. At least one spike 16 or a plurality of spikes extend axially outwardly from a bottom end 12*a* of the anchor 12 and the releasable panel members 14*a*, 14*b*, 14*c* are arranged at a top end 12*b* of the anchor 12 opposite the spikes. The spike 16 is used to secure the anchor 12 to the seabed when the underwater vehicle 10 reaches the seabed. Any suitable number of spikes may be used, such as three spikes which are equidistantly spaced to form a spike tripod for the anchor 12.

The releasable panel members 14*a*, 14*b*, 14*c* are aligned along the longitudinal axis L when the underwater vehicle 10 is in the storage state. A closed housing 17 of the underwater vehicle 10 is formed by the releasable panel members 14*a*, 14*b*, 14*c* being engaged with each other and the closed housing 17 may be cylindrical or ring-shaped. In other embodiments, the closed housing 17 may have another suitable shape. The outer diameter of the closed housing may be similar to the outer diameter of the anchor 12. Any suitable number of releasable panel members 14*a*, 14*b*, 14*c* may be provided. For example, three or more panel members 14*a*, 14*b*, 14*c* may be used. The releasable panel members 14*a*, 14*b*, 14*c* may each be arcuate in shape and elongated along the longitudinal axis L. Each releasable panel member 14*a*, 14*b*, 14*c* has two opposite longitudinal edges 18*a*, 18*b* that are engageable with the longitudinal edges 18*a*, 18*b* of the adjacent releasable panel members 14*a*, 14*b*, 14*c*.

The releasable panel members 14*a*, 14*b*, 14*c* are formed of a positively buoyant material such that when the releasable panel members 14*a*, 14*b*, 14*c* form the closed housing, the underwater vehicle 10 is neutrally buoyant due to the counter buoyant force formed by the releasable panel members 14*a*, 14*b*, 14*c* relative to the negatively buoyant force of the anchor 12. An example of a suitable positively buoyant material is a foam material. Thus, the underwater vehicle 10 is configured to be able to easily travel through the water. In an exemplary application, the underwater vehicle 10 may be carried through the water by an autonomous vehicle or a controlled platform. When in the storage state shown in FIGS. 1 and 2, the releasable panel members 14*a*, 14*b*, 14*c* are held together to form the closed housing by a retaining band 20 that surrounds all of the releasable panel members 14*a*, 14*b*, 14*c*. The retaining band 20 may be continuous and arranged at an end of the releasable panel members 14*a*, 14*b*, 14*c* that is proximate the anchor 12. Other releasable retaining mechanisms may also be suitable for holding the releasable panel members 14*a*, 14*b*, 14*c* together.

The retaining band 20 includes a burn fuse material which is actuated to break the continuous retaining band 20 and release the releasable panel members 14*a*, 14*b*, 14*c* from engagement with each other enabling the underwater vehicle 10 to move out of the storage state. The burn fuse material may be a metal wire formed of any suitable metal material, such as tin, zinc, copper, silver, and alloys thereof, or other metal materials having low melting points. The material may be suitable for burning underwater and the retaining band 20 may be ignited when the underwater vehicle 10 is released from the autonomous vehicle or controlled platform. The material may be configured to burn for a predetermined amount of time when released. Mechanical or electrical actuators may be used to actuate the burn fuse material. Other methods or materials may also be suitable for releasing or breaking the band 20, such as pyrotechnics or other chemical reactions materials.

Each of the releasable panel members 14*a*, 14*b*, 14*c* has a corresponding magnetic arm or element 22 that extends longitudinally along an outer surface of the releasable panel member 14*a*, 14*b*, 14*c* away from the anchor 12 and the retaining band 20. The magnetic element 22 is an elongated magnet having a fixed end portion 22*a* that is secured to the corresponding releasable panel member 14*a*, 14*b*, 14*c* and a releasable end 22*b* opposite the fixed end portion 22*a*. The fixed end portion 22*a* is bonded to the outer surface of the releasable panel member 14*a*, 14*b*, 14*c* and the outer surface may have an elongated groove 24 that retains the fixed end portion 22*a*. Any suitable bonding material may be used such as a waterproof adhesive material. The releasable end 22*b* of the magnetic element 22 is formed distally opposite the fixed end portion 22*a* and a stepped portion 22*c* of the magnetic element 22 may be connected between the fixed end portion 22*a* and a detached portion 22*d* of the magnetic element 22 that is connected to the releasable end 22*b*.

The detached portion 22*d* is arranged radially outwardly relative to the fixed end portion 22*a* and the stepped portion 22*c* is bent radially outwardly from the fixed end portion 22*a* to the detached portion 22*d*. A positively buoyant upper unit or housing 26 is formed separately relative to the releasable panel members 14*a*, 14*b*, 14*c* and is arranged under the detached portion 22*d* of each magnetic element 22. The housing 26 may be formed of any suitable positively buoyant material and the material may be less positively buoyant as compared with the foam material of the releasable panel members 14*a*, 14*b*, 14*c*. The housing 26 has a buoyancy that is positive but still enables the housing 26 to be moved through the seawater. The housing 26 may be formed of a foam material. The foam housing 26 is arranged adjacent the releasable panel members 14*a*, 14*b*, 14*c* along the longitudinal axis L opposite the anchor 12.

The foam material of the foam housing 26 may have a density that is lower than the density of the sea water in which the underwater vehicle 10 is used such that the foam housing 26 is able to be submerged in the sea water while also providing a positive buoyant force that counters the negative buoyant force of the anchor 12. The foam housing 26 may be a uniform body that is cylindrical in shape. An outer diameter of the foam housing 26 may be similar to the outer diameter of the closed housing formed by the releasable panel members 14*a*, 14*b*, 14*c* and the outer diameter of the anchor 12 such that the outermost diameter of the underwater vehicle 10 is substantially continuous resulting in less drag through the water. In other embodiments, the foam housing 26 may have another suitable shape that is similar to the shape of the closed housing formed by the releasable panel members 14*a*, 14*b*, 14*c*.

The detached portion 22*d* of each magnetic element 22 extends over the foam housing 26 in the longitudinal direction without being fixed or secured relative to the foam housing 26. The detached portion 22*d* extends from the releasable panel members 14*a*, 14*b*, 14*c* to the releasable end 22*b* of the magnetic element 22. The releasable end 22*b* is formed as a bent end of the detached portion 22*d* that is bent radially inwardly from the detached portion 22*d* to engage an air-backed electronics housing 28 of the underwater vehicle 10. The electronics housing 28 is arranged adjacent the foam housing 26 opposite the releasable panel members 14*a*, 14*b*, 14*c* and may have a hemispherical shape. Using a hemispherical shape may be advantageous for travel of the underwater vehicle 10 through the water. Any suitable fastening mechanism, such as bolts 30 may be used to secure a lower end 28*a* of the electronics housing 28 to an upper end of the foam housing 26. The electronics housing 28 further includes an attachment member or hook 32 arranged at an upper end 28*b* of the electronics housing 28 which may be used for mounting the underwater vehicle 10 to the autonomous or controlled vehicle before the underwater vehicle 10 is released from the autonomous or controlled vehicle.

Figure 3:
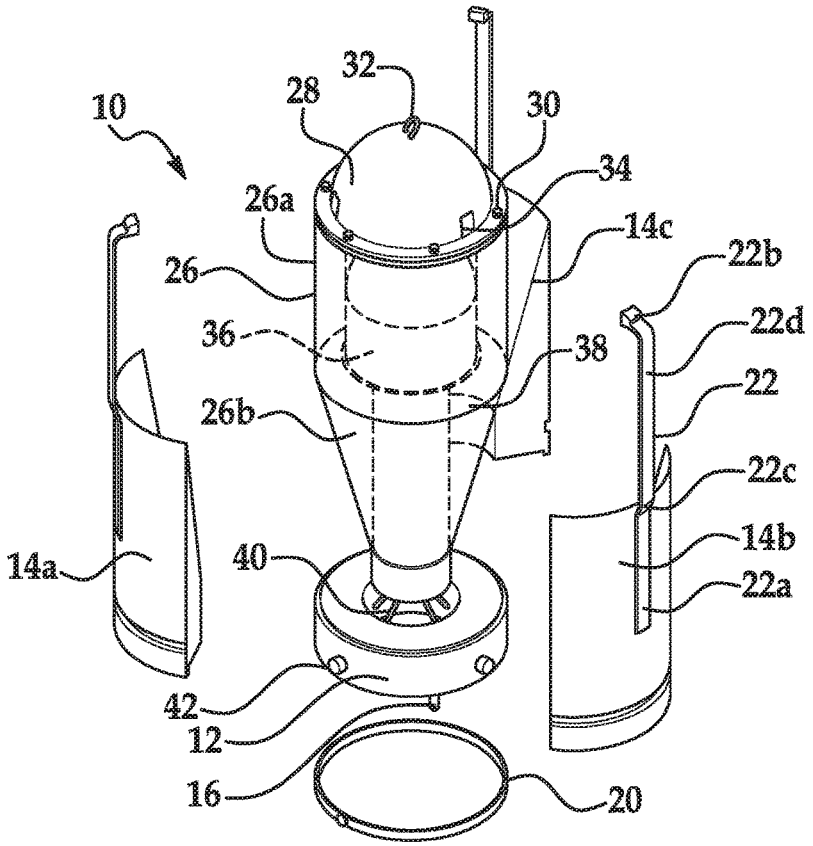
FIG. 3 is a schematic drawing showing an exploded view of the underwater vehicle shown in FIG. 1.
Figure 4:
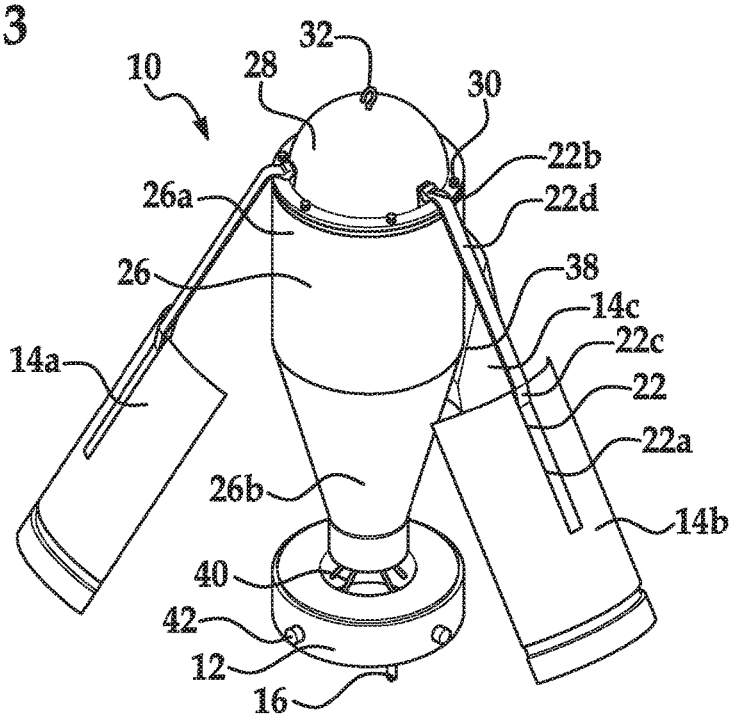
FIG. 4 is a schematic drawing showing a perspective view of the underwater vehicle shown in FIG. 1 when moving from the storage state to a released state.

With further reference to FIGS. 3 and 4, the electronics housing 28 includes at least one magnet contact point 34 and may include a plurality of magnet contact points that are formed as notches at the lower end 28*a* of the electronics housing 28. Each magnet contact point 34 corresponds to a corresponding magnetic element 22. The plurality of magnet contact points are equidistantly spaced around the electronics housing 28. The releasable end 22*b* of each magnetic element 22 is received in the magnet contact point 34 to be retained in the notch when the underwater vehicle 10 is in the storage state, as shown in FIGS. 1 and 2. As best shown in FIG. 4, the releasable end 22*b* is pivotable about the magnet contact point 34 to trigger an actuation mechanism, such as a switch, in the electronics housing 28. When the releasable end 22*b* is pivoted past a predetermined point, as will be described further below, each magnetic element 22 is released from the magnet contact point 34 and the plurality of releasable panel members 14*a*, 14*b*, 14*c* that are bonded to the magnetic elements are separated from the remaining components of the underwater vehicle 10.

As shown in FIGS. 3 and 4, the electronics housing 28 is attached to and in electrical communication with an actuatable effector 36 extending along the longitudinal axis of the underwater vehicle 10. The effector 36 may be a munition, such as a shaped charge, or in other exemplary embodiments, the effector 36 may include an imaging device or camera for imaging a particular region of the seabed. Other types of effectors that are actuatable by the electronics housing 28 may also be suitable. The electronics housing 28 may be attached to an upper end of the effector 36 which is retained within the closed housing formed by the releasable panel members 14*a*, 14*b*, 14*c* when the underwater vehicle 10 is in the storage state, as shown in FIGS. 1 and 2.

The foam housing 26 encompasses the effector 36 and has a cylindrical portion 26*a* and a tapered portion 26*b* that is tapered from the cylindrical portion 26*a* toward the anchor 12. Forming the foam housing 26 to be tapered toward the anchor 12 ensures the vehicle center of buoyancy is high relative to the center of gravity thus creating a righting moment that ensures the foam housing 26 is always above the anchor. When in the storage state, the releasable panel members 14*a*, 14*b*, 14*c* each include a tapered portion 38, as shown in FIGS. 3 and 4 that is formed to be complementary in shape to the tapered portion 26*b* of the foam housing 26 such that the foam material surrounding the effector 36 is substantially uniform along the length of the underwater vehicle 10 when in the storage state.

At least one elastic band 40 or a plurality of elastic bands are connected between the anchor 12 and the effector 36 to enable pivoting of the anchor 12 relative to the housing 26 such that the vertical orientation of the effector 36 is maintained. Each elastic band 40 is secured through the anchor 12 by a fastener 42. Any suitable number of elastic bands may be used and the elastic bands may be formed of a waterproof elastic material. When the releasable panel members 14*a*, 14*b*, 14*c* are released the vehicle becomes negatively buoyant and the anchor 12 pulls the effector 36 through the water toward the target on the seabed. Using the elastic bands and the positively buoyant foam housing 26 maintains the vertical orientation of the effector 36 while the effector 36 moves toward the target since the elastic bands enable the anchor 12 to pivot relative to the foam housing 26. Thus, the configuration of the underwater vehicle 10 advantageously provides an effector 36 having directionality. Other materials or devices, such as pins or ball and socket-type connectors, may also be suitable for enabling pivoting between the anchor 12 and the foam housing 26.

Figure 5:
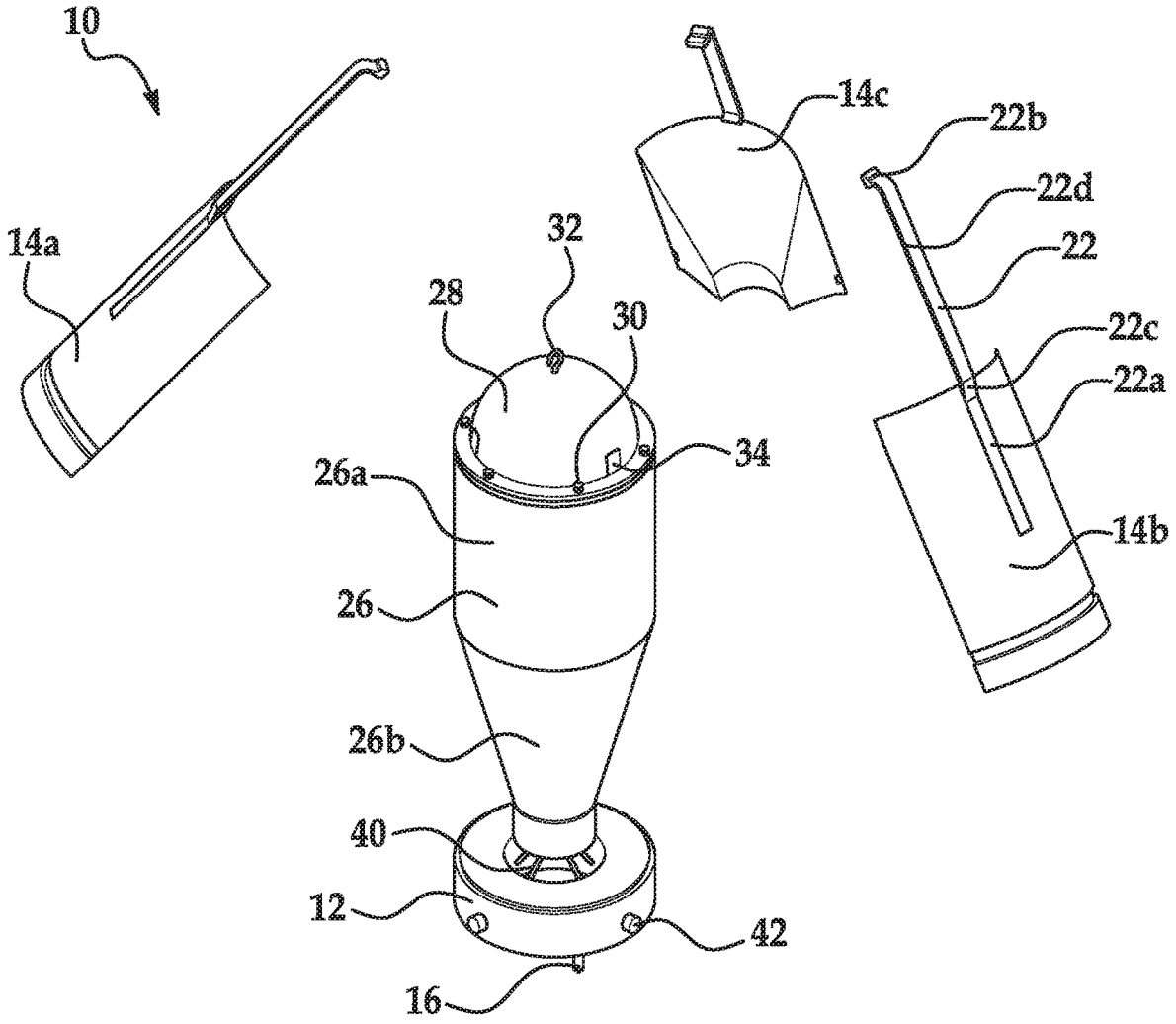
FIG. 5 is a schematic drawing showing a perspective view of the underwater vehicle shown in FIG. 4 when releasable housing panels are separated from the underwater vehicle.
Figure 6:
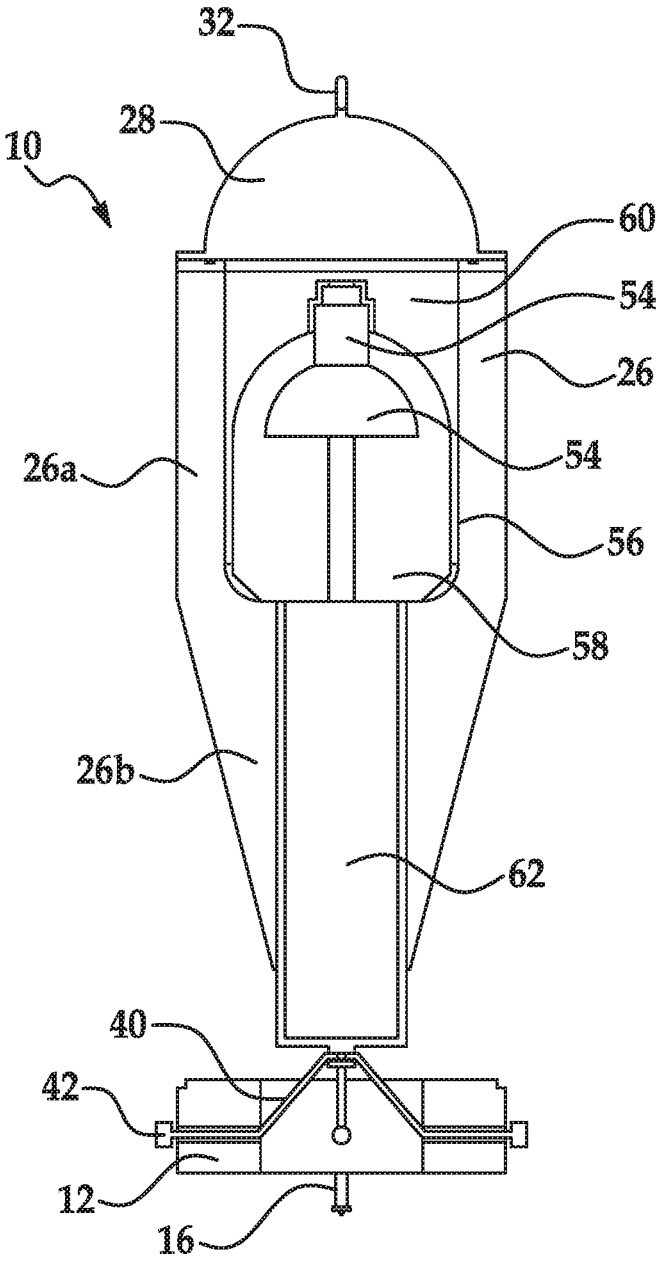
FIG. 6 is a schematic drawing showing a sectional view of the underwater vehicle shown in FIG. 5.
Figure 7:
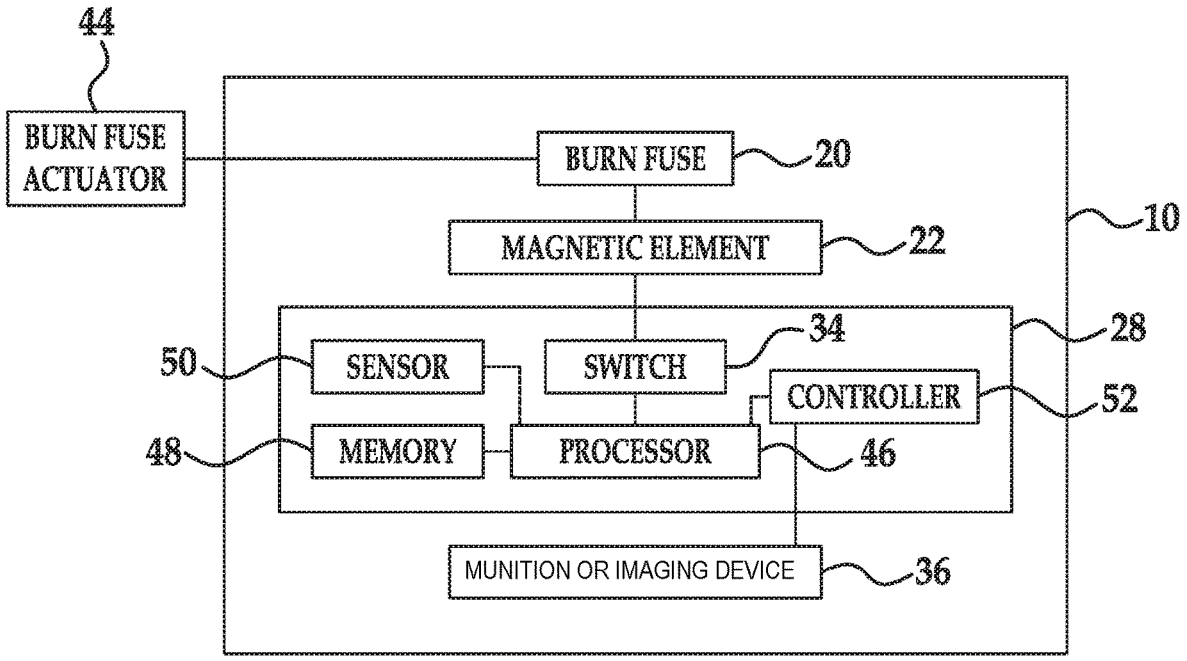
FIG. 7 is a schematic drawing showing an exemplary control system for the underwater vehicle.

Referring in addition to FIGS. 5-7, the underwater vehicle 10 moves out of the storage state to a released position, as shown in FIGS. 5 and 6, using an exemplary control system 58, as schematically shown in FIG. 7. The underwater vehicle 10 may move out of an unpowered storage state to a powered released position. During operation of the underwater vehicle 10, when in the storage state shown in FIGS. 1 and 2, the underwater vehicle 10 may be carried through seawater by an autonomous or controlled carrying vehicle toward a target on the seabed. The carrying vehicle may be unmanned or manned. Using the foam housing 26 and the foam releasable panel members 14*a*, 14*b*, 14*c* enables the underwater vehicle 10 to be neutrally buoyant and travel through the seawater with low resistance when mounted to the carrying vehicle. When the underwater vehicle 10 is to be dropped or released from the carrying vehicle, the hook 32 of the electronics housing 28 of the underwater vehicle 10 is released from the corresponding mount of the carrying vehicle to detach the underwater vehicle 10.

When the underwater vehicle 10 is detached from the carrying vehicle, a mechanical or electrical burn fuse actuator 44 is also actuated to initiate the burning of the burn fuse material in the retaining band 20, as schematically shown in FIG. 7. The actuation may occur manually or automatically when releasing the underwater vehicle 10. When the retaining band 20 is broken, the releasable panel members 14*a*, 14*b*, 14*c* are released from the position in which the releasable panel members 14*a*, 14*b*, 14*c* form the closed position and move radially outwardly from the longitudinal axis L. The releasable, positively buoyant panel members 14*a*, 14*b*, 14*c* move upwardly away from the foam housing 26 as the negatively buoyant anchor 12 pulls the underwater vehicle 10 downwardly through the water toward the seabed.

As the releasable panel members 14*a*, 14*b*, 14*c* are moved upwardly, each magnetic element 22 bonded to the releasable panel members 14*a*, 14*b*, 14*c* is also moved upwardly such that the releasable end 22*b* of the magnetic element 22 is pivoted about the magnet contact point 34 of the electronics housing 28. The magnet contact point 34 of the electronics housing 28 may include a switch or other mechanism that is triggered by pivoting of the magnetic element 22. The magnetic element 22 and the magnet contact point 34 may be configured such that the magnetic element 22 must pivot a predetermined distance to trigger the switch. For example, the magnetic element 22 may be configured to pivot between at least 45 and 120 degrees before the switch is triggered. The magnetically triggered switch in the electronics housing may act as one of several arming devices that must be triggered before the explosive munition may be activated. The switch may be in electrical communication with a processor 46 arranged in the electronics housing 28. The electronics housing 28 may further include a memory 48 that is in electrical communication with the processor 46. The memory 48 may be configured to store a predetermined operation of the effector 36 in a specific application.

The electronics housing 28 may include at least one sensor 50 and the sensor type may be dependent on the application. For example, in an active countermeasure application, the effector 36 may be a munition such as a shaped charge that is actuated by the electronics housing 28 to dispose of a target on the seabed, such as a mine. The effector 36 may be acoustically actuated such that the electronics housing 28 includes a sonar type sensor 50 emitting a series of sonic pings that are reflected back to a receiver or the processor 46 arranged in the electronics housing 28.

The sensor 50 may then communicate with the processor 46 which communicates with a controller 52 that is arranged to detonate the shaped charge effector 36. As shown in FIG. 6, an exemplary shaped charge effector 36 includes a trigger or detonator portion 54 that is in communication with the electronics housing 28 at an upper end of the foam housing 26. The shaped charge effector 36 further includes a conical liner 56 that surrounds an explosive charge 58 that is actuated by the detonator portion 54. An air-filled cavity 60 may be defined between the foam housing 26 and the conical liner 56. When the shaped charge effector 36 is detonated, the underwater vehicle 10 may be expended. Due to the known vertical orientation of the shaped charge effector 36 provided by the foam housing 26, accuracy of the effector 36 in reaching the target is ensured.

In another exemplary application, the effector 36 may be a camera, video sensor, or other imaging device used to image an underwater area such that the controller 52 may operate the camera effector 36 based on a particular characteristic detected by the sensor 50. The sensor 50 may be configured for other exemplary applications. Examples of suitable types of sensors include acoustic or sound sensors, environmental sensors, flow or fluid velocity sensors, and navigation sensors for detecting the depth, the inertia, the turning coordination, or other detectable features of the underwater vehicle 10 or seabed. Navigation sensors may be used to detect the travel trajectory of the underwater vehicle 10. Other suitable sensors include position, speed, and acceleration sensors, and optical sensors. Pressure sensors, density sensors, thermal sensors, proximity sensors, time-of-travel sensors, and range sensors. The aforementioned types of sensors are merely exemplary and many other types of sensors may be suitable.

After the releasable end 22*b* of the magnetic element 22 is pivoted past a predetermined point that is past the predetermined actuation point at which the switch is triggered, the releasable end 22*b* is detachable from the magnet contact point 34. For example, the releasable end 22*b* may pivot between 90 degrees and 180 degrees before the releasable end 22*b* is detached from the magnet contact point 34 after actuating the switch 34. After the releasable end 22*b* is detached from the magnet contact point 34, the releasable panel members 14*a*, 14*b*, 14*c* formed of positively buoyant foam and each magnetic element 22 attached to the releasable panel members 14*a*, 14*b*, 14*c* separates from the underwater vehicle 10 and floats upwardly through the water away from the underwater housing 10, as shown in FIG. 5. In exemplary embodiments, the releasable panel members 14*a*, 14*b*, 14*c* with the magnetic elements may be retrieved from the water and reusable, such as to form another underwater vehicle. The releasable panel members 14*a*, 14*b*, 14*c* may be retrieved by the carrying vehicle.

After the releasable panel members 14*a*, 14*b*, 14*c* are released, the effector 36 descends through the water toward the target on the seabed. The anchor 12 will pull the effector 36 and the attached electronics housing 28 through the water toward the target. The positively buoyant foam housing 26 surrounding the effector 36 opposite the anchor 12 maintains the effector 36 in a vertical orientation during travel and when the underwater vehicle 10 reaches the seabed. As shown in FIG. 6, the at least one spike 16 extends outwardly and downwardly from the anchor 12 and into the seabed. At least one elastic band 40 is supported in the anchor 12 and fastened by the fastener 42.

The effector 36 may include an elongated body 62 that is provided to allow a shaped charge energy stream to form correctly. Each elastic band 40 may be attached between a lower end of the elongated body 62 and the anchor 12. The shape of the effector 36 may be dependent on the application. The effector 36 is pivotable relative to the anchor 12 as the underwater vehicle 10 travels through the water or when the effector 36 is anchored to the seabed. Thus, the anchor 12 may be secured to an uneven seabed in a non-horizontal orientation, but the vertical orientation of the effector 36 will be maintained. The remaining components of the underwater vehicle 10 may then be expended, such as in a countermeasure application, or the underwater vehicle 10 may be used to scan a predetermined area of the seabed.

Figure 8:
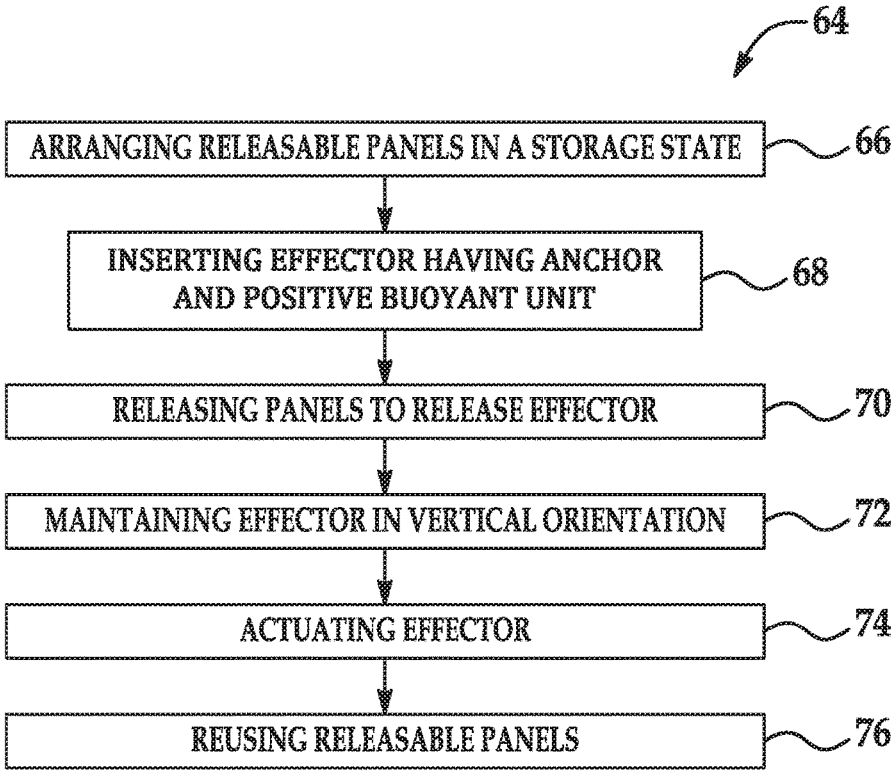
FIG. 8 is a schematic drawing showing a flowchart of a method of forming the underwater vehicle shown in FIG. 1.

Referring now to FIG. 8, a method 64 of deploying the underwater vehicle 10 is shown. One step 66 of the method 82 includes arranging a plurality of releasable panel members 14*a*, 14*b*, 14*c* initially in a storage state, as shown in FIGS. 1 and 2, in which the releasable panel members 14*a*, 14*b*, 14*c* form a closed housing and the underwater vehicle 10 is neutrally buoyant. Another step 68 of the method 64 includes inserting an actuatable effector 36 to be retained in the closed housing, as shown in FIG. 3. The effector 36 has an anchor 12 and a positively buoyant upper unit, such as the foam housing 26, opposite the anchor 12. An air-backed electronics housing 28 is also attached to the effector 36. The effector 36 may be a munition, such as a shaped charge or other low-cost munition, for a countermeasure type application or an imaging device for an underwater imaging application.

Step 70 of the method 64 includes releasing the plurality of releasable panel members 14*a*, 14*b*, 14*c* to release the effector 36. Step 70 may include burning a burn fuse material of a retaining band 20 that surrounds the plurality of releasable panel members 14*a*, 14*b*, 14*c* when in the storage state. Step 72 of the method 64 includes maintaining the effector 36 in a vertical orientation using the anchor 12 and the housing 26 which is positively buoyant. Step 72 may include using a plurality of elastic bands between the anchor 12 and the effector 36 that enable the anchor 12 to pivot relative to the effector 36.

Step 74 of the method 64 includes actuating the effector 36 using at least one magnet 34 of the plurality of releasable panel members 14*a*, 14*b*, 14*c* that engages a magnet contact point 34 of the electronics housing 28 when the plurality of releasable panel members 14*a*, 14*b*, 14*c* are released, as shown in FIGS. 3 and 4. Still another step 76 of the method 82 includes separating the releasable panel members 14*a*, 14*b*, 14*c* from the effector 36 and reusing the plurality of releasable panel members 14*a*, 14*b*, 14*c* to form another underwater vehicle. For example, the effector 36 and the electronics housing 28 may be expended, but the releasable panel members 14*a*, 14*b*, 14*c* may be separable to be retained for later use.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An underwater vehicle comprising:

a plurality of releasable panel members that are initially in a storage state in which the plurality of releasable panel members form a closed housing and the underwater vehicle is neutrally buoyant; and an effector that is retained in the closed housing and comprises a munition or an imaging device, the effector having an anchor and a positively buoyant upper unit opposite the anchor, wherein when the plurality of releasable panel members are released to open the closed housing, the effector is separable from the plurality of releasable panel members and maintained in a vertically downward direction by the anchor and the positively buoyant upper unit.

2. The underwater vehicle according to claim 1 further comprising an electronics housing that is attached to the effector for actuating the effector.

3. The underwater vehicle according to claim 2, wherein the electronics housing includes a plurality of sensors.

4. The underwater vehicle according to claim 2, wherein the electronics housing includes at least one magnet contact point, wherein each of the plurality of releasable panel members includes a magnet that is engageable with the at least one magnet contact point.

5. The underwater vehicle according to claim 4, wherein the magnet is elongated and has a releasable end that is pivotable about a magnet contact point of the electronics housing and a fixed end portion that is bonded to a corresponding one of the plurality of releasable panel members.

6. The underwater vehicle according to claim 1 further comprising a retaining band that surrounds the plurality of releasable panel members when in the storage state.

7. The underwater vehicle according to claim 6, wherein the retaining band is formed of a burn fuse material for releasing the plurality of releasable panel members to open the closed housing.

8. The underwater vehicle according to claim 1, wherein the anchor is formed of a ballast material.

9. The underwater vehicle according to claim 1, wherein the anchor includes a plurality of elastic bands connected between the anchor and the effector.

10. The underwater vehicle according to claim 1, wherein the anchor includes at least one spike.

11. The underwater vehicle according to claim 1, wherein the plurality of releasable panel members are formed of a buoyant foam material.

12. The underwater vehicle according to claim 1, wherein the positively buoyant upper unit is a foam housing that encompasses the effector and is arranged between the effector and the plurality of releasable panel members.

13. The underwater vehicle according to claim 12, wherein the foam housing is tapered along the effector toward the anchor.

14. An underwater vehicle comprising:

a plurality of releasable panel members that are initially in a storage state in which the plurality of releasable panel members form a closed housing and the underwater vehicle is neutrally buoyant; and an actuatable effector that is retained in the closed housing and comprises an imaging device, the effector having an anchor and a positively buoyant upper unit opposite the anchor, wherein when the plurality of releasable panel members are released to open the closed housing, the effector is separable from the plurality of releasable panel members and maintained in a vertically downward direction by the anchor and the positively buoyant upper unit.

15. The underwater vehicle according to claim 14 further comprising an electronics housing that is attached to the effector for actuating the effector.

16. The underwater vehicle according to claim 15, wherein the electronics housing includes a plurality of sensors.

17. The underwater vehicle according to claim 15, wherein the electronics housing includes at least one magnet contact point, wherein each of the plurality of releasable panel members includes a magnet that is engageable with the at least one magnet contact point, wherein the magnet is elongated and has a releasable end that is pivotable about a magnet contact point of the electronics housing and a fixed end portion that is bonded to a corresponding one of the plurality of releasable panel members.

18. The underwater vehicle according to claim 14 further comprising a retaining band that surrounds the plurality of releasable panel members when in the storage state, wherein the retaining band is formed of a burn fuse material for releasing the plurality of releasable panel members to open the closed housing.

19. The underwater vehicle according to claim 14, wherein the plurality of releasable panel members are formed of a buoyant foam material.

20. The underwater vehicle according to claim 14, wherein the positively buoyant upper unit is a foam housing that encompasses the effector and is arranged between the effector and the plurality of releasable panel members.

* * * * *